US008845818B2

(12) United States Patent
Lonski

(10) Patent No.: US 8,845,818 B2
(45) Date of Patent: Sep. 30, 2014

(54) METERING DEVICE FOR THE METERED ADDITION OF DETERGENTS

(75) Inventor: Rudolf Lonski, Golling (AT)

(73) Assignee: Henkel AG & Co. KGaA, Duesseldorf (DE)

( * ) Notice: Subject to any disclaimer, the term of this patent is extended or adjusted under 35 U.S.C. 154(b) by 115 days.

(21) Appl. No.: 13/094,020

(22) Filed: Apr. 26, 2011

(65) Prior Publication Data

US 2011/0226808 A1 Sep. 22, 2011

Related U.S. Application Data

(63) Continuation of application No. PCT/EP2009/063652, filed on Oct. 19, 2009.

(30) Foreign Application Priority Data

Oct. 27, 2008 (DE) ..... 10 2008 053 312

(51) Int. Cl.

| | |
|---|---|
| ***A47L 15/44*** | (2006.01) |
| ***A47L 15/46*** | (2006.01) |
| ***A47L 15/00*** | (2006.01) |
| *D06F 39/02* | (2006.01) |

(52) U.S. Cl.

CPC ..... *D06F 39/02* (2013.01); *A47L 15/4454* (2013.01); *A47L 15/006* (2013.01); *A47L 15/4463* (2013.01)

USPC ..... 134/56 D; 134/57 D; 134/58 D

(58) Field of Classification Search

USPC ..... 134/56 D

See application file for complete search history.

(56) References Cited

U.S. PATENT DOCUMENTS

| | | | | |
|---|---|---|---|---|
| 4,247,899 | A * | 1/1981 | Schiller et al. | 705/413 |
| 4,408,640 | A * | 10/1983 | Voza | 141/1 |
| 6,685,093 | B2 * | 2/2004 | Challa et al. | 235/462.46 |
| 7,264,166 | B2 * | 9/2007 | Barkan | 235/462.21 |
| 2007/0044819 | A1 * | 3/2007 | Chan et al. | 134/18 |

FOREIGN PATENT DOCUMENTS

| | | | |
|---|---|---|---|
| AT | 006 023 | U1 | 3/2003 |
| DE | 201 15 173 | U1 | 12/2001 |
| DE | 20 2008 001 532 | U1 | 5/2008 |
| WO | WO 2007/027779 | A1 | 3/2007 |

OTHER PUBLICATIONS

William Reusch, "Visible and Ultraviolet Spectroscopy", p. 1, no date.*

* cited by examiner

*Primary Examiner* — Joseph L Perrin
*Assistant Examiner* — Levon J Shahinian
(74) *Attorney, Agent, or Firm* — David K. Benson

(57) ABSTRACT

A dispensing apparatus for dispensing substances, such as cleaning, washing, or dishwashing agents, in household appliances such as washing machines, dishwashers, or the like, having a dispensing unit having control means to control dispensing of the substances, and a tank receptacle, a tank for stocking the substances, the tank being embodied as a replaceable unit connectable to the tank receptacle, at least one connection for data transmission between the dispensing unit and the tank, at least one connection for data transmission between the household appliance and the tank and/or the dispensing unit.

17 Claims, 9 Drawing Sheets

METERING DEVICE FOR THE METERED ADDITION OF DETERGENTS

CROSS-REFERENCES TO RELATED APPLICATIONS

This is a continuation of International Application No. PCT/EP2009/063652, filed Oct. 19, 2009, which claims priority to German Patent Application No. DE102008053312.2 filed Oct. 27, 2008, both of which are hereby incorporated by reference.

FIELD OF THE INVENTION

The present invention generally relates to a dispensing apparatus for dispensing substances, such as cleaning, washing, or dishwashing agents, in household appliances such as washing machines, dishwashers, or the like; and to a household appliance.

BACKGROUND OF THE INVENTION

A wide variety of dispensing systems for reception in the working space of a household appliance is known from the existing art. Such household appliances are, for example, cleaning machines, washing machines, or dishwashing machines. The document WO 02/077353 A1, for example, describes a dispensing system of this kind for washing substances.

In the context of such dispensing apparatuses, a basic distinction can be made between autonomous dispensing apparatuses and appliance-coupled dispensing apparatuses. An "appliance-coupled" dispensing apparatus is understood for purposes of the invention as a dispensing apparatus that can receive and/or emit signals from or to the household appliance and that is operable only in a household appliance specifically designed for the dispensing apparatus or is operable only as a dispensing apparatus specifically coordinated with a particular household appliance.

BRIEF SUMMARY OF THE INVENTION

The object of the invention is to propose a dispensing apparatus and a household appliance in which improved coordination between the dispensing apparatus and household appliance is enabled.

Proceeding from the existing art recited initially, the object is achieved by the features of Claim 1 and the features of Claim 11, respectively.

The features recited in the dependent claims make possible advantageous embodiments and refinements of the invention.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
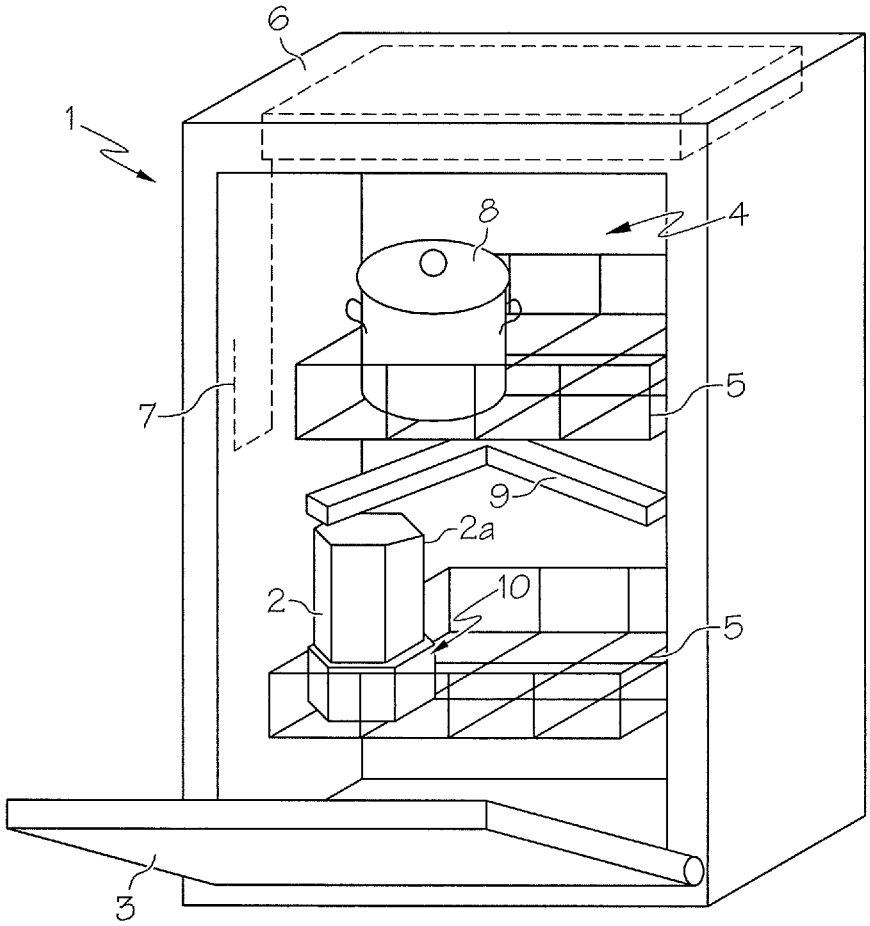
FIG. 1 is a front perspective view which schematically depicts a dishwasher with an open loading door and a working space into which a dispensing apparatus is introduced.

The following detailed description of the invention is merely exemplary in nature and is not intended to limit the invention or the application and uses of the invention. Furthermore, there is no intention to be bound by any theory presented in the preceding background of the invention or the following detailed description of the invention.

A dispensing apparatus according to the present invention for dispensing substances, such as cleaning, washing, or dishwashing agents, in household appliances such as washing machines, dishwashers, or the like, accordingly comprises:

- a dispensing unit having control means to control dispensing of the substances, and a tank receptacle;
- a tank for stocking the substances, the tank being embodied as a replaceable unit connectable to the tank receptacle;
- at least one connection for data transmission between the dispensing unit and the tank, at least one connection for data transmission between the household appliance and the tank and/or dispensing unit.

For purposes of the invention, the dispensing apparatus according to the present invention thus encompasses in principle a dispensing unit and a tank. The corresponding substances, in particular washing and cleaning substances as well as dishwashing agents, can be stocked in the tank.

The tank itself is suitable for being introduced into the dispensing unit or being received thereby. For this reason, the dispensing unit is equipped with a corresponding tank receptacle. The dispensing unit furthermore encompasses control means to control dispensing of the substances. These can be, inter alia, corresponding flaps, valves, an associated actuator suite, and other means for dispensing substances or for controlling dispensing.

The tank itself is embodied as a replaceable unit. It is thus suitable for attachment onto or introduction into the dispensing unit in the region of the tank receptacle. The connection between the tank unit and dispensing unit can be produced in various ways, for example by way of snap-in apparatuses, fitting pins, screw connections, plug-in connections, guide rails, or the like.

The tank is embodied in particular to receive flowable washing or cleaning agents. Particularly preferably, a tank of this kind comprises a plurality of chambers each for physically separated reception of mutually differing preparations of a washing or cleaning agent. Some possible combinations for filling the chambers with different preparations are listed below in exemplifying but not exhaustive fashion:

| | Chamber 1 | Chamber 2 | Chamber 3 | Chamber 4 |
|---|---|---|---|---|
| A | Alkaline cleaning preparation | Enzymatic cleaning preparation | — | — |
| B | Alkaline cleaning preparation | Enzymatic cleaning preparation | Rinse aid | — |
| C | Alkaline cleaning preparation | Enzymatic cleaning preparation | Rinse aid | Scent |
| D | Alkaline cleaning preparation | Enzymatic cleaning preparation | Rinse aid | Disinfectant preparation |
| E | Alkaline cleaning preparation | Enzymatic cleaning preparation | Rinse aid | Pretreatment preparation |

It is particularly preferred that all preparations be flowable, since this ensures rapid dissolution of the preparations in the washing bath of the dishwasher, with the result that these preparations achieve a rapid to immediate cleaning or rinsing effect.

The chambers of a tank can have volumetric capacities that are identical to or different from one another. In the case of a configuration having two chambers, the ratio of chamber volumes is preferably 5:1, for a configuration having three chambers preferably 4:1:1, these configurations being suitable in particular for use in dishwashers.

As mentioned above, the tank preferably possesses three chambers. For use of a tank of this kind in an automatic dishwasher, it is particularly preferred that one chamber contain an alkaline cleaning preparation, a further chamber an enzymatic preparation, and a third chamber a rinse aid, the volume ratio of the chambers being equal to approximately 4:1:1.

The chamber containing the alkaline cleaning preparation preferably has the largest volumetric capacity of the chambers that are present. The chambers that store an enzymatic preparation and a rinse aid, respectively, preferably have approximately the same volumetric capacity.

In the case of a two- and/or three-chamber embodiment of the tank, it is possible to stock, in particular, a scent preparation, disinfectant preparation, and/or pretreatment preparation in a further chamber arranged detachably on the tank or on the dispensing device.

The tank encompasses a cartridge base that, in the use position, is directed downward in the direction of gravity, and on which at least one outlet opening arranged in the direction of gravity at the bottom is preferably provided for each chamber. The outlet openings arranged at the bottom are, in particular, embodied in such a way that at least one outlet opening, and preferably all outlet openings, are communicatively connectable to the inlet openings of the dispensing unit, i.e. preparation can flow through the outlet openings out of the cartridge into the dispensing device, preferably under the influence of gravity.

There further exists, in the context of a dispensing apparatus according to the present invention, at least one connection for data transmission between the dispensing unit and the tank. "Data" means, for purposes of the invention, e.g. washing or cleaning parameters, i.e. for example information regarding a dose, temperatures, various washing programs, discharge duration, codes, as well as instructions, control commands, and specifications for washing program execution, etc. The data transmission can be limited to proceeding in one direction, but it can likewise proceed in both directions. A data transmission of this kind can, for example, serve to ensure a kind of "friend or foe" detection, i.e. so that the dispensing unit and/or the tank recognize whether the tank and dispensing unit fit one another, are compatible, are from the same manufacturer, etc. It is also conceivable to ascertain by means of a data transmission of this kind whether, for example, an appropriate cleaner is stocked in the tank. Further data that can be transmitted are, for example, information about the extent to which the tank has already been emptied, but also including, inter alia, control instructions as to how exactly dispensing must occur during the washing program.

In principle, the possibility also exists of accommodating discharge valves, flaps, the actuator suite and/or parts of the actuator suite for the discharge of substances not (or only partially) in the dispensing unit, but instead in the tank. For example, corresponding control signals could be conveyed via a corresponding connection for data transmission from the dispensing unit to the tank, so that the corresponding actuator suite in the tank carries out the dispensing action. It is similarly conceivable, however, to accommodate valves or an actuator suite or flaps in the dispensing unit, and to empty the tank by way of them.

A dispensing apparatus according to the present invention moreover encompasses at least one connection for data transmission between the household appliance and the tank and/or dispensing unit.

The dispensing apparatus according to the present invention is therefore an appliance-coupled dispensing apparatus. A possibility therefore exists, in principle, for a data transmission either in one direction or in both directions between the household appliance and the dispensing apparatus. The data transmission can either occur between the household appliance and the tank, between the household appliance and the dispensing unit, or between the household appliance and the tank, as well as simultaneously between the household appliance and the dispensing unit. Here as well, the data can in principle involve codes, but also, for example, corresponding washing parameters, doses, temperatures, discharge times, and any instructions for dispensing, with reference to the cleaning programs, etc.

It is conceivable in principle for the household appliance to convey dispensing instructions to the dispensing apparatus so that, for example, the corresponding dispensing actuator suite and the corresponding dispensing valves can be operated and actuated accordingly. It is also conceivable, however, for the dispensing apparatus conversely to convey instructions to the household appliance. For example, a dispensing apparatus (or even only the tank as a replaceable unit) might be suitable only for the cleaning of specific tableware, for example for particularly heavily soiled stainless steel pots or for particularly sensitive tableware. In this case the dispensing apparatus of the household appliance could indicate the washing program that is to be selected, i.e. for example the water temperature, water volume, and cycle duration, or which washing nozzles are currently to be activated. It is also conceivable, for example, for the dispensing apparatus to intervene in corrective fashion, in particular using corresponding sensors, so that the household appliance is, for example, informed when the corresponding operating temperature has been set too high or too low.

In a particularly preferred refinement of the dispensing apparatus, at least one connection for data transmission is embodied as a wireless connection. This can involve, in principle, both the connection between the tank unit and dispensing unit and a connection between the dispensing apparatus, i.e. the tank and/or the dispensing unit, and the household appliance. Various types of wireless connection are conceivable, in particular a radio frequency identification (RFID) connection, a radio connection, e.g. via a ZigBee or EnOcean system, a connection via a Bluetooth interface, or the like.

In principle, a connection via an infrared interface can also be provided. This can be notable, in particular, for economical manufacture.

Wireless connections of this kind are notable for a number of advantages. These are, in particular, established and economical means for data transmission.

In an advantageous refinement of the invention, an interface is embodied on the dispensing unit and on the household appliance, for example an automatic dishwasher, to transfer (i.e. send and receive) electromagnetic and/or optical signals that represent, in particular, operating-status, measurement, and/or control data of the dispensing unit and/or of the household appliance.

It is of course possible to provide only an interface for the transfer of signals or an interface for the transfer of electrical energy, or one interface for the transfer of signals and one interface for the transfer of electrical energy, respectively, or to provide an interface that is suitable for providing a transfer of both electrical energy and signals.

An interface of this kind can be embodied in particular in such a way that a wireless transfer of electrical energy and/or electromagnetic and/or optical signals is produced.

It is particularly preferred that the interface be configured for the emission and/or reception of optical signals. It is very particularly preferred that the interface be configured for the emission and reception of light in the visible region. Because darkness usually prevails in the interior of the washing space during operation of an automatic dishwasher, signals in the visible optical region, for example in the form of signal pulses or light flashes, can be emitted and/or detected by the dispensing unit. It has proven particularly advantageous in this context to use wavelengths between 600 and 800 nm in the visible spectrum.

Alternatively or additionally, it is advantageous for the interface to be configured for the emission and reception of infrared signals. It is advantageous in particular for the interface to be configured for the emission and reception of infrared signals in the near infrared region (780 nm to 3000 nm).

The interface encompasses in particular at least one LED. Particularly preferably, the interface encompasses at least two LEDs. It is also possible, according to a further preferable embodiment of the invention, to provide at least two LEDs that emit light at wavelengths differing from one another. This makes it possible, for example, to define different signal bands on which data can be sent and received.

It is further advantageous, in a refinement of the invention, for at least one LED to be an RGB LED whose wavelength is adjustable. It is thus possible, for example, to define with one LED a variety of signal bands that emit signals at different wavelengths. It thus also conceivable, for example, that during the drying operation, during which high humidity (mist) is present in the washing space, light is emitted at a different wavelength than, for example, during a washing step.

The interface of the dispensing device can be configured so that the LED is provided both for the emission of signals into the interior of the dishwasher, in particular when the dishwasher door is closed, and for optical indication of an operating state of the dispensing device, in particular when the dishwasher door is open.

It is particularly preferred that an optical signal be embodied as a signal pulse having a pulse duration of between 1 ms and 10 second, preferably between 5 ms and 100 ms.

It is further advantageous that the interface of the dispensing device be configured in such a way that it emits an optical signal, when the dishwasher is closed and unloaded, that produces an average illumination intensity E of between 0.01 and 100 lux, preferably between 0.1 and 50 lux, measured at the walls delimiting the washing space. This illumination intensity is then sufficient to produce multiple reflections with or at other washing-space walls, thereby reducing or preventing signal shadows in the washing space, especially when the dishwasher is in the loaded state.

The signal emitted and/or received by the interface is in particular a carrier of information, in particular a control signal or a signal that represents an operating state of the dispensing device and/or of the dishwasher.

In an advantageous refinement of the invention, the dispensing device can encompass at least one optical receiving unit. This makes it possible, for example, for the dispensing device to receive signals from an optical transmitting unit arranged in the household appliance. This can be implemented by way of any suitable optical receiving unit, for example photocells, photomultipliers, semiconductor detectors, photodiodes, photoresistors, solar cells, phototransistors, CCD and/or CMOS image sensors. It is particularly preferred that the optical receiving unit be suitable for receiving light in the wavelength region from 600 to 800 nm.

The RFID system is proven and established specifically for "friend or foe" detection, e.g. the transmission of codes. In addition, systems such as RFID or Bluetooth systems can be accommodated in particularly space-saving fashion practically anywhere. They furthermore generally exhibit low energy consumption. The possibility moreover exists of also transferring energy simultaneously with the transmission of data. It is thus also conceivable to use a wireless connection of this kind for energy delivery.

Parameter instructions and other data can likewise be transferred and, depending on the implementation of the system, also stored.

Especially in the case of transfer paths of wireless connections within the working space of a household appliance, it may be advantageous to ensure that the frequency or frequency range selected for the transfer is one in which excessive absorption by water does not take place.

For a variety of reasons, it may be advantageous to embody at least one connection for data transmission as a hard-wired connection. Combinations of wireless connections and a hard-wired connection are also possible, for example a hard-wired connection between the tank and dispensing unit, and a wireless connection between the household appliance and dispensing apparatus.

With regard to the configuration of the connections for data transmissions, different hierarchies between the individual stations are also conceivable. For example, at least one of the connections for data transmissions is embodied as a master-slave bus. For example, the household appliance could in principle function as master, while the dispensing unit and tank are addressed as slaves. A master-slave bus of this kind can be used, for example, when corresponding control instructions are outputted by the master and are to be executed by the corresponding slaves.

In a further embodiment of the invention, the dispensing unit comprises a controlling unit to control dispensing and/or the cleaning program. A "controlling unit" for purposes of the invention is understood either as a unit that can emit control instructions or as a unit that additionally possesses a closed-loop control system that is implemented on the basis of measured values, controlling parameters, etc. A controlling unit of this kind can, for example, also be connected to sensors. Control instructions of this kind from the controlling unit can, for example, be conveyed directly to the actuator suite, but they can also, in particular, be conveyed via one of the connections for data transmission.

In a preferred refinement of the invention, the dispensing unit and/or the tank comprise at least one coding unit for transmitting and/or decrypting codes by means of at least one connection for data transmission. As already mentioned, a coding system of this kind could serve for "friend or foe" detection, i.e., for example, as to whether an appropriate dispensing apparatus authorized by the manufacturer was being used, or whether an appropriate tank has been placed onto a dispensing unit. In addition to strict "friend or foe" detection, however, it is also possible to perform, for example, model detection by way of the coding, for example so that the dispensing apparatus detects which household appliance it has been inserted into or, for example, the household appliance detects which dispensing apparatus is currently present.

As has already been mentioned, it may be particularly advantageous in the context of data transmission if the dispensing unit and/or the tank comprise at least one memory for storing identification codes, washing parameters, execution parameters of cleaning programs, instructions, or the like. This makes it possible to improve dispensing even further, namely also, in particular, to store new washing programs or also, if applicable, to modify old programs, washing parameters, etc. In some circumstances a selection of different parameters, programs, or instructions can thus also take place.

It is particularly preferred to provide at least one sensor such as, for example, a conductivity sensor, temperature sensor, or the like, that is connected to the controlling unit of the dispensing unit. In the specific case in which the controlling unit also performs closed-loop control operations, it is advantageous if this control action is performed, for example, on the basis of measured values. In an embodiment, it would be possible to ascertain by means of a temperature sensor the temperature that currently exists in the working space, and thereby the cleaning substance that needs to be released. It is likewise conceivable to ascertain thereby, for example, that too high or too low a temperature exists, and to convey this to the household appliance so that a correction can take place. It is also possible for the household appliance to execute a program that has been set by the user on the control panel of the household appliance, and for the dispensing apparatus to detect, on the basis of the sensors, the program that is currently being executed.

In addition, an advantageous refinement of the dispensing apparatus is notable for the fact that the dispensing unit encompasses at least one mechanical coding unit for reception of the tank. To prevent, for example, an incorrect tank from being connected to a dispensing unit, it is possible to provide corresponding sockets, adapters, fitting pins, guides, etc. so that only correspondingly embodied tanks can be connected to the dispensing unit in a manner appropriate for dispensing.

A mechanical coding system of this kind between the tank and dispensing unit can be provided either as the only coding system but also in the same way in conjunction with a code that is conveyed via a connection for data transmission. A coding system of this kind can thus serve for selection of the correct dispensing action or the correct control action during dispensing, or (as already mentioned) for "friend or foe" detection. It is advantageous in both cases that, for example, damage to the appliance, to the dispensing apparatus, or also, for example, to the objects to be cleaned can be avoided, which damage may occur e.g. as a consequence of incorrect dispensing actions, discharge of the wrong cleaning substances, mechanical or electrical problems in the context of incompatible devices, or the like.

A household appliance according to the present invention is accordingly notable for the fact that at least one connection for data transmission to a dispensing apparatus according to one of the aforesaid claims is present. The household appliance and dispensing apparatus must consequently be coordinated with one another in such a way that such data transmission becomes possible.

The connection for data transfer can be embodied, in correspondence with an associated dispensing apparatus, as a wireless connection, e.g. as an RFID system or a Bluetooth system, as another radio system, or also can represent a wire-conducted connection. As already discussed in conjunction with the dispensing apparatus, it is likewise possible to provide at least one coding unit for the transmission and/or decrypting of codes by means of at least one connection for data transmission. In principle, a connection for data transmission both to the tank and/or to the dispensing unit can be present.

Similarly to the situation in the dispensing apparatus, provision can likewise be made for storage of identification codes, washing parameters, execution parameters, cleaning program instructions, or the like. In embodiments of the invention it is also possible, by way of the link between the dispensing apparatus and household appliance, for example to implement a dispensing controlling function in the dispensing apparatus.

It is therefore advantageous that a controlling unit is provided in order to control dispensing and/or the cleaning program by means of washing parameters, execution parameters or cleaning programs, or instructions in the household appliance.

If, for example, closed-loop control of dispensing, or also control of program execution via measured values such as conductivity, water temperature, etc., is performed, then in a preferred refinement of the invention at least one sensor such as, for example, a conductivity sensor, a temperature sensor, or the like, which is connected to the controlling unit of the household appliance, is present in the household appliance.

The household appliance can furthermore also encompass at least one mechanical coding unit in order to receive the dispensing apparatus. It has already been mentioned that in an embodiment of the invention, the tank unit and dispensing unit can be configured so that they can be connected to one another, for example, via a corresponding socket. In similar fashion, the dispensing apparatus can also be introduced into and received in, for example, a socket that is integrated into the working space of the household appliance.

In particular, operation of the household appliance and/or of the dispensing apparatus can also be made, on the part of the manufacturer, to depend on whether, for example, the dispensing apparatus has been correctly introduced into the corresponding mechanical coding unit of the household appliance.

In a simple case, for example, a corresponding contact could be triggered e.g. via a fitting pin.

In principle, however, such coding actions are possible, for example, by way of the connection for data transmission, for example by way of the transmission of codes via RFID.

In general, a further advantage of a dispensing apparatus according to the present invention or a household appliance according to the present invention could consist in improving adaptability to technical developments in conjunction with cleaning-agent chemistry.

For example, if permanent washing programs are provided in the control system of a household appliance, it may happen that these programs can no longer, in terms of their execution, optimally ensure interaction with novel cleaning agents if the latter require, for example, different working conditions, water temperatures, contact times or washing times, etc.

In addition, it is in fact conceivable for individual washing steps to be added or eliminated, depending on how many individually dispensed substances are required for a washing cycle.

An embodiment of the invention therefore makes it possible to store the corresponding information regarding the optimum execution of a washing program in, for example, a memory unit, and to convey it via data transmission to the household appliance so that the household appliance adapts the water temperature, and also the washing steps in other ways, to the cleaning agent or agents.

In similar fashion, however, control could also be exercised by the household appliance on the dispensing apparatus.

In an even more flexible configuration the tank could also, as a function of cleaning agents stocked therein, contain that information for dispensing or for program execution, and convey that information, for example with regard to water temperature and washing duration, to the household appliance, while the point in time for dispensing and the dispensed quantity are conveyed to the dispensing unit from the tank via the connection for data transmission. This refinement would allow a corresponding washing sequence to be adapted not only to individual requirements but also to new developments in cleaning-agent chemistry.

A particularly preferred embodiment of the invention consists in the fact that a radio connection is provided between the household appliance and the dispensing unit.

In addition, an RFID connection is present between the dispensing unit and the tank. Transmission of, for example, control instructions, washing parameters, or the like between the household appliance and the dispensing unit can thus occur. The household appliance can in turn authorize the dispensing unit, via an instruction, to poll (by means of the RFID connection between the dispensing unit and tank) an identification code for identification of the tank, and transmit it to the household appliance. If applicable, the energy necessary for this is transferred in this context from the dispensing unit via the RFID connection to the tank.

In an embodiment of the invention, at least one antenna is integrated with the dispensing unit and/or the tank in order to create a wireless connection. The household appliance generally comprises a working space into which, for example, objects to be cleaned are introduced and cleaned. This working space is often at least partly surrounded by a metallic wall or lining. Because such a space acts as a Faraday cage and thus can also, for example, attenuate, interfere with, or even block radio signals, it is advantageous to mount the antenna inside the working space.

The metallic wall often comprises at least one water passthrough for the passage of water, for example a water inlet, corresponding nozzles, or a water outflow, etc. The at least one antenna can accordingly also be mounted or integrated thereinto. In many cases the metallic wall also comprises at least one cutout. This can be the case for reasons of physical construction, but in some circumstances also for visual design reasons. Cutouts of this kind are also used or provided for the purpose of mounting therein other apparatuses such as e.g. a housing or sensors, dispensing devices, or water softeners, in particularly those that comprise a non-metallic housing. The at least one antenna can be integrated into such a housing.

A particular advantage of these mounting possibilities for the antenna is that as a rule an additional cutout in the wall is not necessary; this can reduce costs and also offer better sealing of the working space since there are fewer locations that need to be sealed.

With respect to a reduced metal surface area, it may be possible to achieve improved cooling. In addition, assembly complexity can be decreased by using cutouts and apparatuses in the wall that are already present.

FIG. 1 shows a dishwasher 1 with an open loading door 3. The open loading door 3 provides a view into working space 4. Visible in this working space 4 are racks 5 into which can be placed tableware 8 to be cleaned. Also visible in working space 4 is a rotor 9 that, for example, ensures wetting of tableware 8 to be cleaned. Indicated at the top of dishwasher 1 is a controlling unit or appliance controller 6 of dishwasher 1. Connected to this controlling unit 6 is an antenna 7 that extends laterally from working space 4. One of racks 5 encompasses a placement apparatus 10 into which a dispensing apparatus 2 is introduced. Dispensing apparatus 2 encompasses a hexagonal housing 2*a*.

Figure 2:
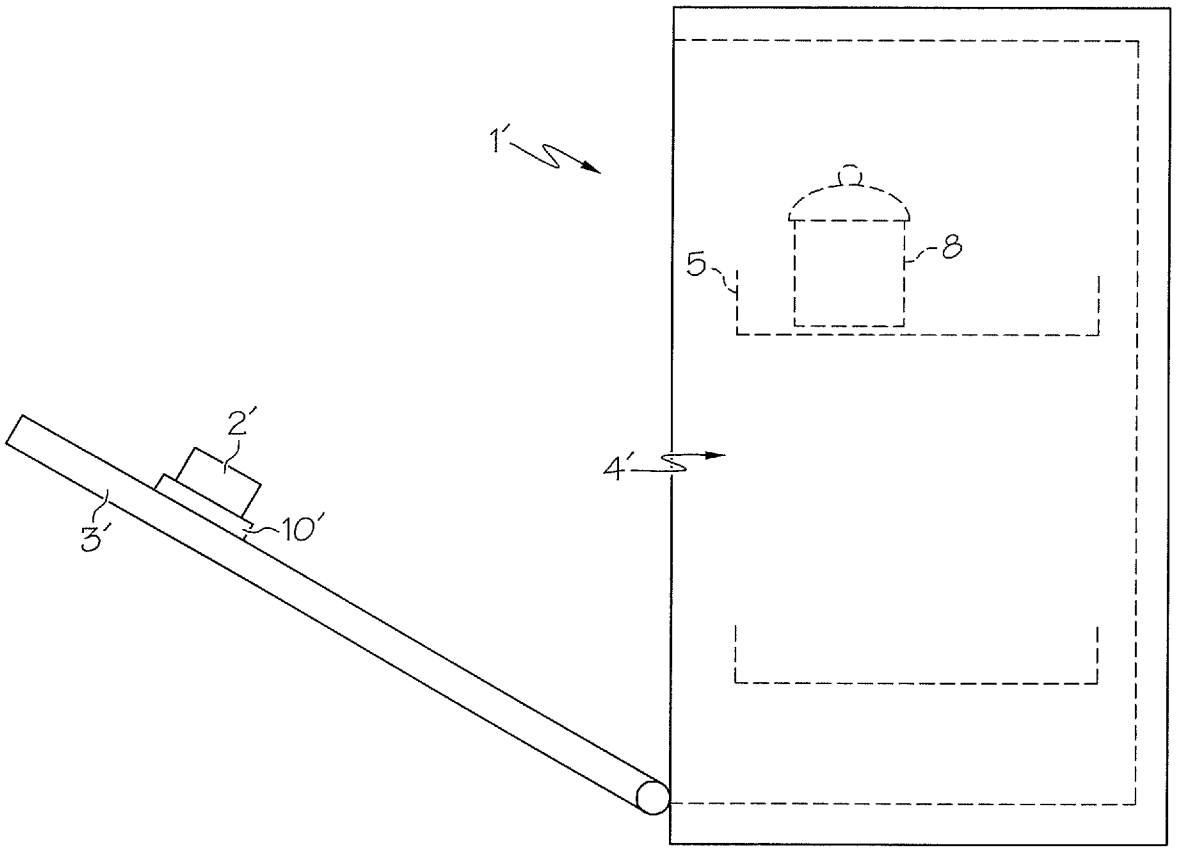
FIG. 2 is a side view which schematically depicts a dishwasher in which the dispensing apparatus is placed on the door.

A similar dishwasher 1' is shown in FIG. 2. FIG. 2 shows overall a side view of dishwasher 1' with an open loading door 3'. Working space 4, racks 5 present therein, and tableware 8 to be cleaned are indicated by dashed lines. Loading door 3' encompasses a placement apparatus 10' into which dispensing apparatus 2' is introduced.

Figure 3:
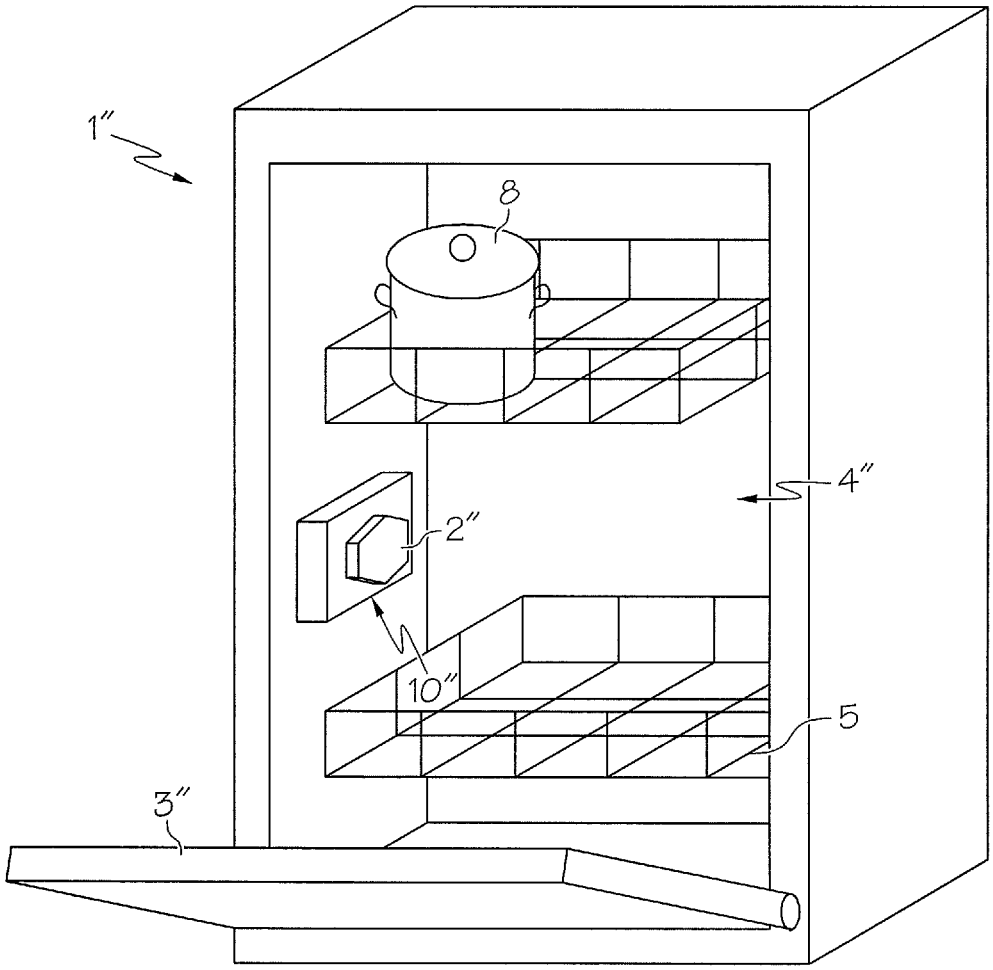
FIG. 3 is a perspective view which shows a dishwasher in which the dispensing apparatus is mountable in the working space on a lateral inner wall.

FIG. 3 shows a dishwasher 1" with an open loading door 3" and a working space 4". Visible in working space 4" are corresponding racks 5 as well as tableware 8 to be cleaned. Located on a side wall in the interior of working space 4" is placement apparatus 10", into which a hexagonal dispensing apparatus 2" is introduced.

The dishwashers 1, 1', and 1" shown in FIGS. 1, 2, and 3 are essentially very similar household appliances in which, however, dispensing apparatuses 2, 2', and 2" are simply mounted at different locations in working space 4, 4', and 4".

Figure 4:
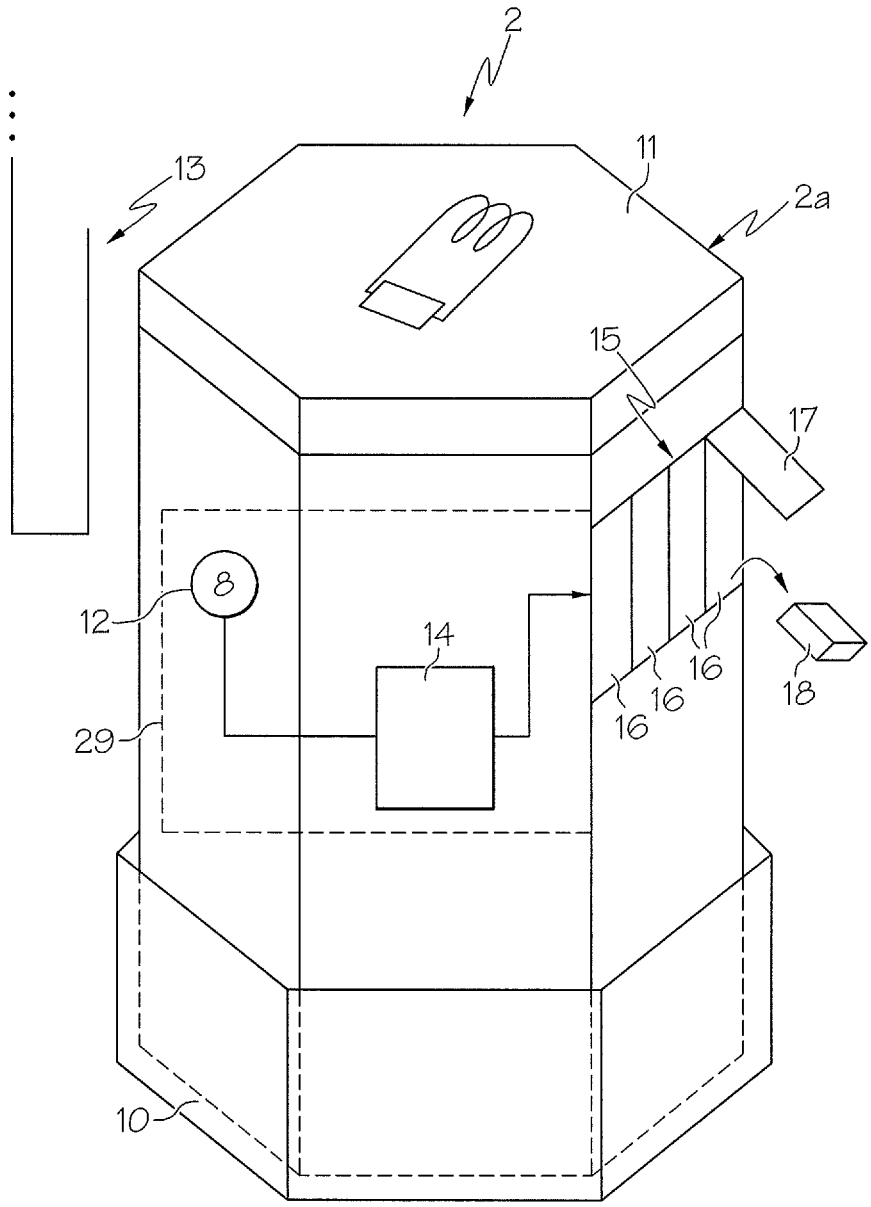
FIG. 4 is a perspective view which schematically depicts a dispensing apparatus is a corresponding placement apparatus.

A more detailed diagram of a dispensing apparatus 2 is illustrated in FIG. 4. Dispensing apparatus 2 is introduced into a placement apparatus 10. Dispensing apparatus 2 furthermore encompasses an energy supply unit 11 for inductive energy transfer, and a controlling unit 14 that is connected to a Bluetooth antenna 12 and controls the dispensing of cleaning agents 18. The electrical apparatus of controlling unit 14 with Bluetooth antenna 12 is encapsulated, encapsulation 29 being indicated by a dashed line. Dispensing apparatus 2 furthermore encompasses a multi-chamber system 15 having individual chambers 16 for stocking cleaning agents 18.

Chambers 16 are preferably designed so that they can stock at least twice the dose required for one washing cycle. This multi-chamber system 15 is controllable, with regard to dispensing, via controlling unit 14. Chambers 16 furthermore encompass chamber doors 17 that can be opened for dispensing and ensure that corresponding cleaning agents 18, whether a liquid cleaning agent or a solid cleaner, can enter working space 4. An antenna 7 is provided in dishwasher 1 for data transfer to and from Bluetooth antenna 12.

Figure 5:
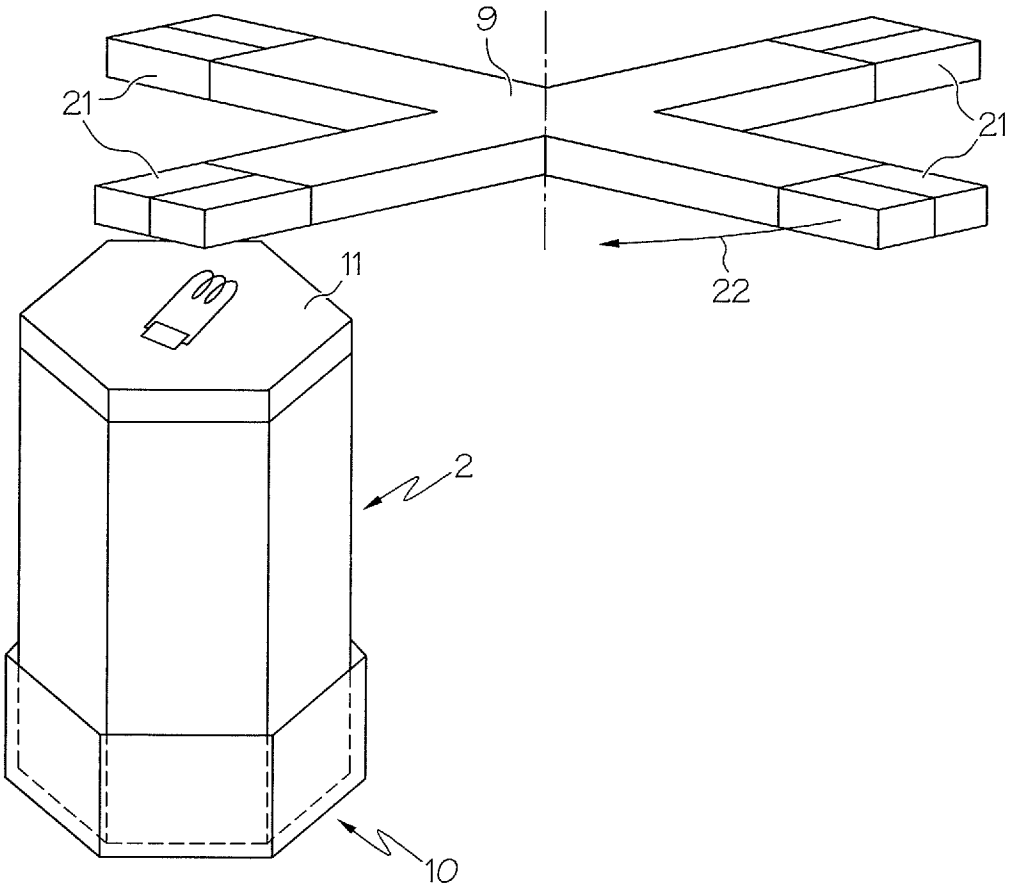
FIG. 5 is a perspective view which schematically depicts the mounting of a dispensing apparatus having an energy supply unit with reference to a rotor.

One possibility for wirelessly configuring the energy supply of dispensing apparatus 2 is explained in FIG. 5. It depicts a rotor 9 that can rotate in rotation direction 22. Permanent magnets 21 are integrated onto the rotor blades of rotor 9. Rotor 9 itself serves, during a washing cycle in a dishwasher 1, to wet tableware 8 that is to be washed. Dispensing apparatus 2 is mounted in a placement apparatus 10 in the immediate vicinity of rotor 9. Energy supply unit 11 for inductive energy transfer is placed in such a way that the field lines of permanent magnets 21 can pass through the coil and can thus induce a voltage.

Figure 6:
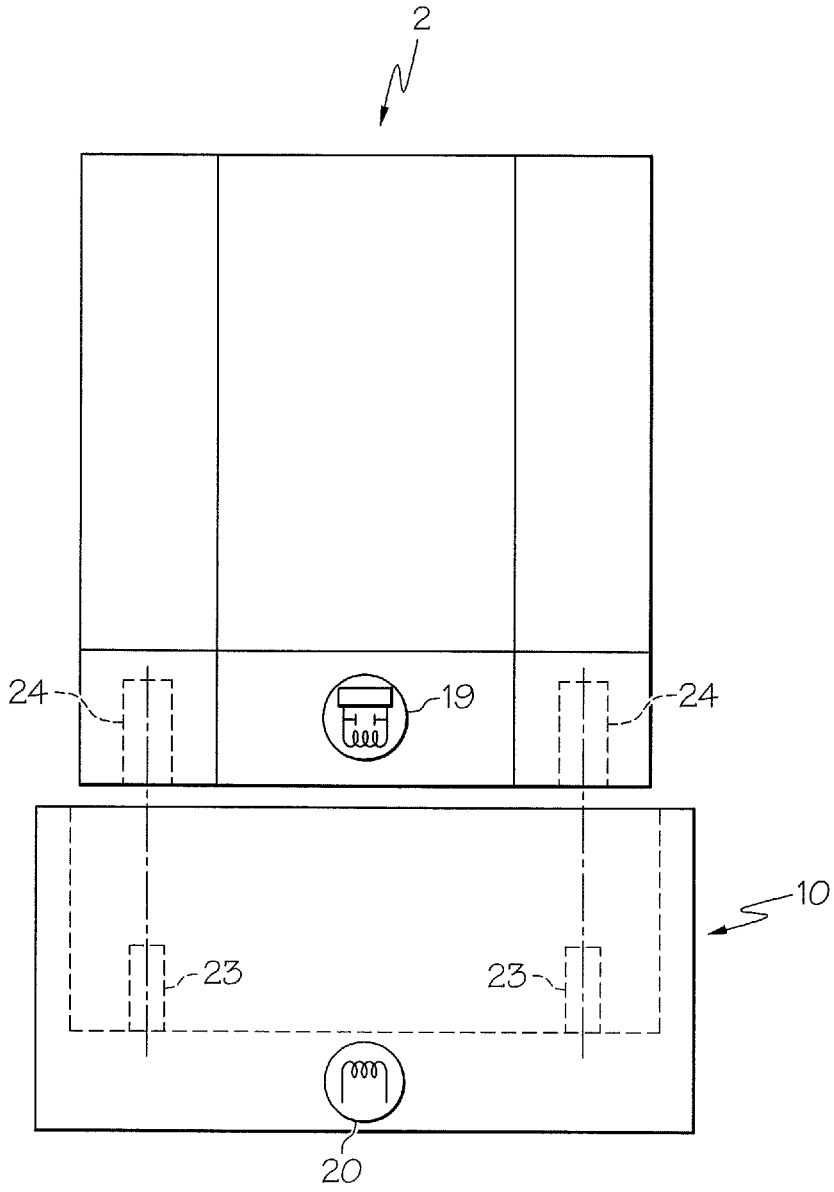
FIG. 6 is a diagram which schematically depicts the introduction of a dispensing apparatus having coding units into a placement apparatus.

FIG. 6 shows how a dispensing apparatus 2 having corresponding coding units 19, 24 can be introduced into a placement apparatus 10 having coding units 20, 23. Dispensing apparatus 2 is hexagonal in configuration, and its shape fits exactly into placement apparatus 10. Placement apparatus 10 additionally encompasses fitting pins 23 which additionally ensure that dispensing apparatus 2, having corresponding sockets 24, is inserted in the correct orientation into placement apparatus 10.

In addition, dispensing apparatus 2 encompasses an RFID transponder 19, and placement apparatus 10 encompasses a corresponding RFID reading device 20.

Figure 7:
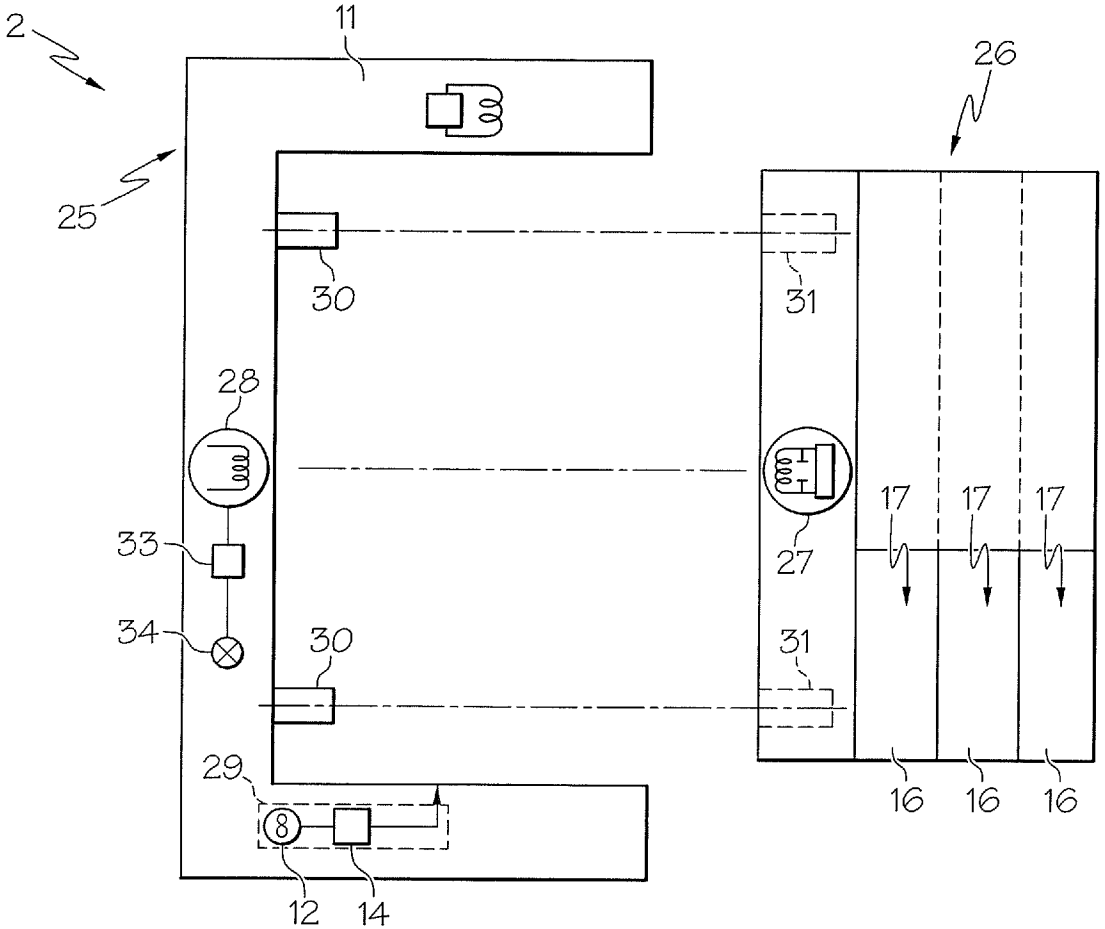
FIG. 7 is a diagram which schematically depicts a dispensing apparatus having a replaceable unit that encompasses chambers.

FIG. 7 presents an embodiment of a dispensing apparatus 2 having a replaceable unit 26. Replaceable unit 26 serves here to stock cleaning agents 18. Dispensing apparatus 2 is embodied in such a way that it encompasses a console 25 into which replaceable unit 26 can be introduced. In this exemplifying embodiment the console simultaneously encompasses energy supply unit 11, controlling unit 14 having a Bluetooth antenna 12, and a corresponding encapsulation 29 of controlling unit 14 and Bluetooth antenna 12. Controlling unit 14 serves here substantially to control dispensing. Console 25 possesses fitting pins 30 in addition to a recess for the introduction of replaceable unit 26.

Provided in replaceable unit 26 are corresponding sockets 31 therefor. Replaceable unit 26 furthermore encompasses an RFID transponder 27, while console 25 possesses an RFID reading unit 28 having a warning apparatus 33 connected thereto as well as a warning LED 34.

Figure 8:
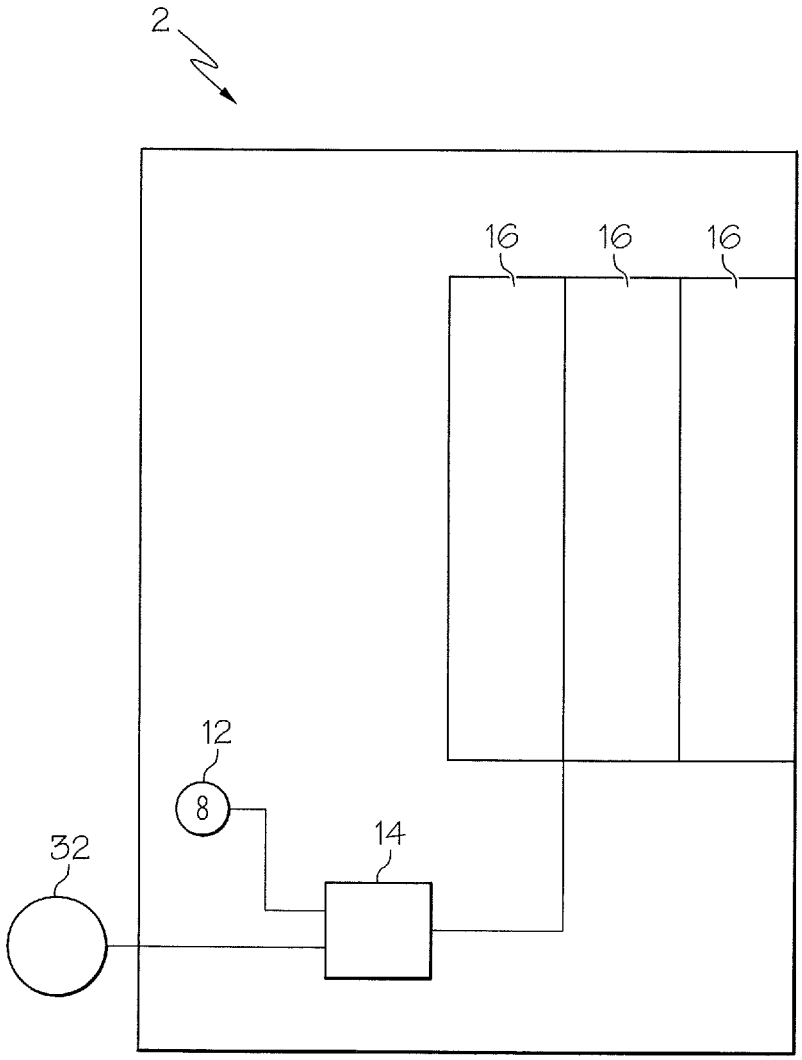
FIG. 8 is a diagram which schematically depicts a dispensing apparatus having a sensor.

FIG. 8, on the other hand, shows a dispensing apparatus 2 having multiple dispensing chambers 16, and a controlling unit 14 to control dispensing, to which a Bluetooth antenna 12 is connected. In order to make dispensing autonomous, i.e. independent of a dishwasher 1, a sensor 32 is furthermore connected to controlling unit 14. A variety of types of sensor 32 can be involved, for example a pH sensor, a temperature sensor, or the like. In principle, multiple sensors 32 can also be connected to a controlling unit of this kind. Depending on the embodiment of a dishwasher 1, 1', and 1", dispensing apparatuses 2, 2', and 2", respectively can be mounted at different locations in working space 4, 4', and 4", respectively. The selection correlates essentially with the construction and design of corresponding dishwashers 1, 1', 1", and depending on the appliance model can be adapted either in order to ensure short path lengths for wireless connections or to allow cleaning agent 18 to be introduced at the optimum point for the corresponding appliance model. A further reason for placing a dispensing apparatus 2 at a specific location could also be that corresponding sensors 32 can operate at locations in a working space 4 that are representative for measurements, e.g. in the vicinity of tableware 8 that is to be cleaned.

FIG. 4 shows, for example, a dispensing apparatus 2 in which controlling unit 14 for dispensing cleaning agents 18 is connected via a Bluetooth connection to appliance controller 6. This could mean, for example, that appliance controller 6 transfers instructions for dispensing, via antenna 7, to Bluetooth antenna 12, in which context controlling unit 14 can carry out a corresponding dispensing action during the corresponding washing cycle. It is likewise also possible, however, for controlling unit 14 to take on the dispensing control task independently, for example according to a predetermined program, and for the Bluetooth connection to be used only to transfer to appliance controller 6 a code with which, for example, it is possible to ascertain whether dispensing apparatus 2 is compatible with household appliance 1.

FIG. 5 depicts an inductive energy supply system. Instead of using a rotor 9, whose basic function is to wet the tableware 8 to be cleaned, simultaneously for energy supply, it is also possible to use a rotor designed independently for energy supply.

Coding units can be very useful, in particular, so as to avoid improper operation. It has already been mentioned that, for example, a Bluetooth antenna 12 can also be used to transfer corresponding coding signals, thus making possible device identification, for example in the context of a wireless connection to appliance controller 6. One implementation of a coding function that as a rule is technically simple is to provide mechanical coding units.

In FIG. 6, dispensing apparatus 2 is hexagonal in configuration and possesses a receiving shape that fits correspondingly with placement apparatus 10. A coding function of this kind can be additionally assisted by the presence of fitting pins 23 and corresponding sockets 24. An orientation of dispensing apparatus 2 upon insertion into a placement apparatus 10 can also be predefined both by way of a corresponding shape of a dispensing apparatus 2 and by corresponding fitting pins 23 and associated sockets 24, so that a user has no choice but to insert the dispensing apparatus correctly. A further possibility is to implement a coding unit by way of a wireless connection. It is particularly advantageous to use RFID transponders, which can be acquired inexpensively and can be miniaturized in such a way that they can be integrated practically anywhere.

In FIG. 6 an RFID transponder 19 is accordingly incorporated into dispensing apparatus 2. Placement apparatus 10 encompasses a corresponding RFID reading device 20. Transponder 19 is activated when the electromagnetic wave emitted from reading device 20 possesses a frequency such that a resonance is achieved in transponder 19. Transponder 19 can moreover contain a microchip that additionally, for example, conveys in such a case an electrical signal, for example a warning notification in the event of improper operation or an "OK" signal when dispensing apparatus is used according to specifications.

In addition to a microchip of this kind, memory units can also be present, for example in order to store the number of washing cycles for which a corresponding dispensing apparatus 2 has been used. In principle, the microchip could also convey signals to a controlling unit 14, for example so that the latter is activated and can authorize a dispensing operation during a washing cycle. A further embodiment consists in equipping either sockets 24 or fitting pins 23 with contacts, for example pushbuttons, so that upon introduction of dispensing apparatus 2 according to specifications, for example, activation of a controlling unit 14 is simultaneously performed.

Once cleaning agent 18 has been exhausted after a certain period, either it must be topped up in a dispensing apparatus 2 or at least a portion of dispensing apparatus 2 that contains cleaning agent 18 must be exchanged. It is generally preferably to provide a replaceable unit 26 for this purpose, so that skin contact with cleaning agents can at least be reduced to a minimum or, in some circumstances, entirely avoided. A replaceable unit 26 of this kind can also encompass corresponding coding units. In this case, for example, replaceable unit 26 encompasses sockets 31 for corresponding fitting pins 30 introduced into console 25. In principle, the cutout in console 25 is provided in such a way that replaceable unit 26 can be introduced. Replaceable unit 26 furthermore encompasses an RFID transponder 27 that can be activated by a reading device 28 in console 25. A warning apparatus 33, which illuminates a warning LED 34 in the event of improper operation, is furthermore connected.

A replaceable unit 26 suitable for introduction into console 25 must also be configured so that a dispensing action, in this case e.g. an opening of chamber doors 17, can be authorized by a controlling unit 14 that in this case is mounted in console 25.

FIG. 8, on the other hand, shows a dispensing apparatus 2 having sensors 32 that are connected, for example, to controlling unit 14. It is conceivable to embody a dispensing apparatus 2 of this kind so that dispensing can proceed entirely autonomously, i.e. independently of dishwasher 1. For example, a corresponding wash cycle can be detected by the fact that a sensor measures the temperature. Other detected values are, for example, the pH or relative humidity. In a context of corresponding measured values, controlling unit 14 can detect a program in the washing cycle, start a dispensing operation, or even correct a dispensing operation that has already been performed if, for example, the pH does not correspond to a desired value.

A photosensor can also be used as sensor 32, for example in order to detect the beginning or end of a program or also an interruption or continuation of a program when loading door 3 is opened. It is also conceivable for corresponding data to be conveyed, via coding unit, 14 and, for example, Bluetooth device 12 and antenna 7 to appliance controller 6 of dishwasher 1. One possibility would be, for example, to inform appliance controller 6 that the temperature in working space 4 does not correspond to a desired temperature, so that appliance controller 6 can authorize corresponding countermeasures.

Figure 9:
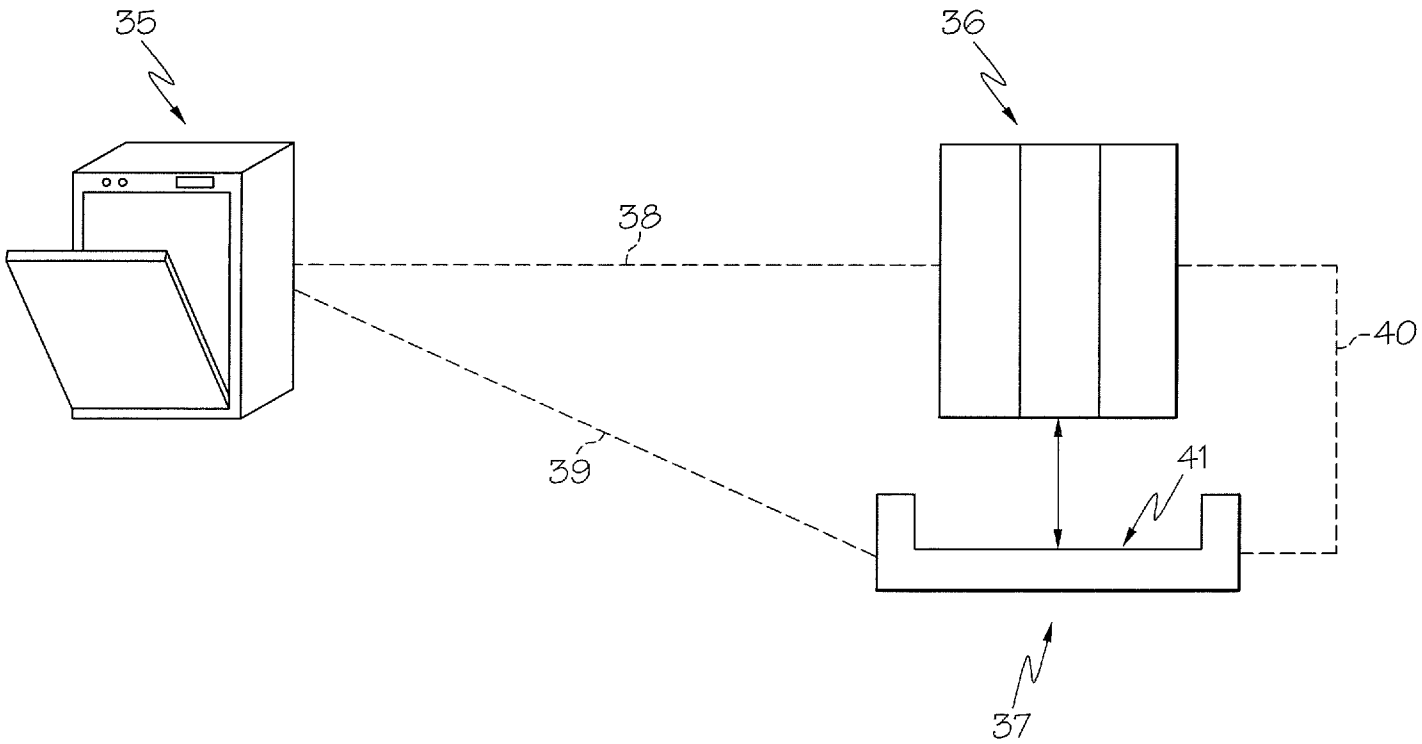
FIG. 9 is a diagram which correspondingly shows the connections for data transmissions that can, for example, be provided.

As shown in FIG. 9, a connection exists in principle from dishwasher 35 to the dispensing apparatus, which is made up of a dispensing unit 37 and a tank 36 that is embodied as a replaceable unit. At least one connection will therefore exist: the connection between household appliance 35 and tank 36, or connection 39 between household appliance 35 and dispensing unit 37. Both connections 38 and 39 can, however, also exist.

A connection 40 moreover exists between tank 36 and dispensing unit 37. The arrow pointing in both directions between tank 36 and dispensing unit 37 indicates that tank 36 can be received in the receiving apparatus of dispensing unit 37.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A dispensing apparatus (2, 2', 2"; 36, 37) for dispensing one or more cleaning substances in a household appliance, the apparatus comprising:

a dispensing unit (25, 37) having control means to control dispensing of the substances;

a tank receptacle (23, 24, 30, 31, 41);

a tank (26, 36) for stocking the substances, the tank (26, 36) being embodied as a replaceable unit connectable to the tank receptacle (41);

at least one connection for data transmission (40) between the dispensing unit (25, 37) and the tank (26, 36); and at least one connection for data transmission (38, 39) between the household appliance (1, 1', 1"; 35) and at least one of the tank (26, 36) and the dispensing unit (25, 37) while the tank and dispensing unit are situated inside the household appliance, the connection for data transmission beinnfigured for the emission and/or reception of optical signals in the visible region, wherein the tank (26, 36) comprises a controlling unit (14) to control dispensing and/or a cleaning program, the controlling unit being disposed on the tank and sized to be received with the tank by the tank receptacle.

2. The dispensing apparatus (2, 2', 2"; 36, 37) according to claim 1, wherein the at least one connection for data transmission (38, 39, 40) is configured for the emission and/or reception of optical signals in the region of a wavelength between 600 and 800 nm.

3. The dispensing apparatus (2, 2', 2"; 36, 37) according to claim 1, wherein at least one connection for data transmission (38, 39, 40) is configured for the emission and/or reception of an optical signal as a signal pulse or a sequence of signal pulses having a pulse duration of between 1 ms and 10 seconds.

4. The dispensing apparatus (2, 2', 2"; 36, 37) according to claim 3, wherein at least one connection for data transmission (38, 39, 40) is configured for the emission and/or reception of an optical signal as a signal pulse or a sequence of signal pulses having a pulse duration of between 5 ms and 100 ms.

5. The dispensing apparatus (2, 2', 2"; 36, 37) according to claim 1, wherein at least one connection for data transmission (38, 39, 40) is a hard-wired connection.

6. The dispensing apparatus (2, 2', 2"; 36, 37) according to claim 1, wherein at least one connection for data transmission (38, 39, 40) is a master-slave bus.

7. The dispensing apparatus (2, 2', 2"; 36, 37) according to claim 1, wherein the dispensing unit (25, 37) comprises a controlling unit (14) to control dispensing and/or the cleaning program.

8. The dispensing apparatus (2, 2', 2"; 36, 37) according to claim 1, wherein the dispensing unit (25, 37) comprises at least one coding unit for transmitting and/or decrypting codes by means of at least one connection for data transmission (38, 39, 40).

9. The dispensing apparatus (2, 2', 2"; 36, 37) according to claim 1, wherein the dispensing unit (25, 37) comprises at least one memory for storing at least one data type selected from the group consisting of identification codes, washing parameters, execution parameters of cleaning programs, and instructions.

10. The dispensing apparatus (2, 2', 2"; 36, 37) according to claim 1, wherein the controlling unit (14) is embodied to control dispensing and/or the cleaning program by means of data selected from the group consisting of washing parameters, execution parameters of cleaning programs, and instructions.

11. The dispensing apparatus (2, 2', 2"; 36, 37) according to claim 1, further comprising at least one sensor (32) that is connected to the controlling unit of the dispensing unit (25, 37).

12. The dispensing apparatus (2, 2', 2"; 36, 37) according to claim 1, wherein the dispensing unit (25, 37) encompasses at least one mechanical coding unit (23, 24, 30, 31, 41) for reception of the tank (26, 36).

13. A household appliance (1, 1', 1"; 35), comprising the dispensing apparatus according to claim 1, and at least one connection for data transmission to the dispensing apparatus (2, 2', 2"; 36, 37).

14. A dispensing apparatus (2, 2', 2"; 36, 37) for dispensing one or more cleaning substances in a household appliance, the apparatus comprising:

a dispensing unit (25, 37) having control means to control dispensing of the substances;

a tank receptacle (23, 24, 30, 31, 41);

a tank (26, 36) for stocking the substances, the tank (26, 36) being embodied as a replaceable unit connectable to the tank receptacle (41);

at least one connection for data transmission (40) between the dispensing unit (25, 37) and the tank (26, 36) while the tank and dispensing unit are situated inside the household appliance, the connection for data transmission being configured for the emission and/or reception of optical signals in the visible region; and at least one connection for data transmission (38, 39) between the household appliance (1, 1', 1"; 35) and at least one of the tank (26, 36) and the dispensing unit (25, 37), wherein the tank (26, 36) comprises at least one coding unit for transmitting and/or decrypting codes by means of at least one connection for data transmission (38, 39, 40), the coding unit being disposed on the tank and sized to be received with the tank by the tank receptacle.

15. A household appliance (1, 1', 1"; 35), comprising the dispensing apparatus according to claim 14, and at least one connection for data transmission to the dispensing apparatus (2, 2', 2"; 36, 37).

16. A dispensing apparatus (2, 2', 2"; 36, 37) for dispensing one or more cleaning substances in a household appliance, the apparatus comprising:

a dispensing unit (25, 37) having control means to control dispensing of the substances;

a tank receptacle (23, 24, 30, 31, 41);

a tank (26, 36) for stocking the substances, the tank (26, 36) being embodied as a replaceable unit connectable to the tank receptacle (41);

at least one connection for data transmission (40) between the dispensing unit (25, 37) and the tank (26, 36); and at least one connection for data transmission (38, 39) between the household appliance (1, 1', 1"; 35) and at least one of the tank (26, 36) and the dispensing unit (25, 37) while the tank and dispensing unit are situated inside the household appliance, the connection for data transmission being configured for the emission and/or reception of optical signals in the visible region, wherein the tank (26, 36) comprises at least one memory for storing at least one data type selected from the group consisting of identification codes, washing parameters, execution parameters of cleaning programs, and instructions, the memory being disposed on the tank and sized to be received with the tank by the tank receptacle.

17. A household appliance (1, 1', 1"; 35), comprising the dispensing apparatus according to claim 16, and at least one connection for data transmission to the dispensing apparatus (2, 2', 2"; 36, 37).

* * * * *